US006089216A

United States Patent [19]

Harwath et al.

[11] Patent Number: 6,089,216

[45] Date of Patent: Jul. 18, 2000

[54] ADJUSTABLE ARROW REST

[75] Inventors: Frank A. Harwath, Downers Grove; Miroslav A. Simo, Riverside, both of Ill.

[73] Assignee: New Archery Products Corp., Forest Park, Ill.

[21] Appl. No.: 09/226,500

[22] Filed: Jan. 7, 1999

[51] Int. Cl.[7] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,476,846 | 10/1984 | Carville | 124/44.5 |
| 4,548,188 | 10/1985 | Simo . | |
| 4,732,135 | 3/1988 | Simo . | |
| 5,179,930 | 1/1993 | Simo | 124/44.5 |
| 5,245,980 | 9/1993 | Colvin | 124/24.1 |
| 5,467,759 | 11/1995 | Troncoso | 124/44.5 |
| 5,535,728 | 7/1996 | Prodigo | 124/44.5 |

*Primary Examiner*—John A. Ricci
*Attorney, Agent, or Firm*—Pauley Petersen Kinne & Fejer

[57] ABSTRACT

An arrow rest for an archery broadhead having a support shaft extending from a bracket. A first support arm having a first arcuate end is wrapped around the support shaft and is adjustable in a vertical and/or a horizontal direction. A post having a second support arm with a second arcuate end wrapped around the post may extend at an angle from the support shaft. The arrow rest may additionally include a means for positioning the first support arm along an angular path with respect to the bracket.

18 Claims, 4 Drawing Sheets

ADJUSTABLE ARROW REST

BACKGROUND OF THE INVENTION

1. Field of the Invention

This invention relates to an arrow rest for an archery broadhead wherein a support shaft extends from a bracket, the support shaft including a first support arm having a first arcuate end wrapped around the support shaft.

2. Description of Prior Art

Conventional arrow rests often provide for three dimensional adjustment with respect to an archery bow riser. Conventional arrow rests typically include one or more support arms for supporting an arrow, specifically an arrow shaft, in the vertical and horizontal direction. Such conventional arrow rests are typically adjustable in a vertical direction and a horizontal direction to accommodate arrow shafts of various diameters and innumerable variables required by different bows and archers.

Some conventional arrow rests utilize one or more support arms made from spring steel which is inexpensive, flexible and durable. Such conventional arrow rests often do not permit the adjustment of a support arm in the horizontal direction without losing the position in the vertical direction. In addition, such conventional arrow rests may permit the horizontal and/or vertical adjustment of the support arm even in a fully tightened condition.

There exists an apparent need for an arrow rest constructed of inexpensive materials that permits a desired adjustment of a support arm in the horizontal and/or the vertical direction into a tightly fixed position.

SUMMARY OF THE INVENTION

It is one object of this invention to provide an arrow rest, for an archery broadhead, which has at least one support arm having an arcuate end that wraps around a support shaft or a post.

It is another object of this invention to provide an arrow rest that tightly holds a horizontal and vertical position of at least one support arm.

It is another object of this invention to provide an arrow rest that is adjustable in a virtually infinite number of positions.

The above and other objects of this invention are accomplished with an arrow rest having a bracket and a support shaft extending from the bracket. The support shaft preferably extends so that the support shaft is slideably mounted with respect to the bracket.

A first support arm is preferably connected with respect to the support shaft. The first support arm preferably has a first arcuate end and an opposite first support end. The first arcuate end is wrapped around the support shaft such that an inner surface of the arcuate end at least partially follows the contour of an outer surface of the support shaft.

The arrow rest may further comprise a post extending at an angle, and preferably perpendicular, from the support shaft. A second support arm having a second arcuate end and a second support end is connected with respect to the post. Like the first arcuate end and the support shaft, the second arcuate end is preferably wrapped around the post.

The first support arm and/or the second support arm are preferably connected to the support shaft and/or the post, using a retention block. The retention block fixes the first arcuate end with respect to the support shaft and/or the second arcuate end with respect to the post. The retention block preferably comprises one or more components, including a screw and a washer having an inner surface corresponding with an outer surface of the first arcuate end and/or the second arcuate end. A fastener, such as a set screw, is preferably used to affix the washer with respect to the first arcuate end and/or the second arcuate end, thus firmly attaching the first support arm and/or the second support arm with respect to the arrow rest.

The arrow rest may additionally comprise a means for positioning the first support arm along an angular path with respect to the bracket. Such means for positioning may include an angled slot positioned in the first arcuate end of the first support arm for adjusting the first support arm at a predetermined angle to support a variety of diameters of shafts. Alternatively, an adjustment mechanism may be used for positioning the first support arm along an angular path with respect to the bracket. The adjustment mechanism may comprise a retention block that slides along an angled portion of the support shaft. As a result of the adjustment mechanism, the first support arm may be adjusted along a fixed angular path to accommodate a variety of diameters of shafts.

DETAILED DESCRIPTION OF THE DRAWINGS

The above and other features of this invention become more apparent when taken in view of the drawings, wherein.

DESCRIPTION OF PREFERRED EMBODIMENTS

Figure 1:
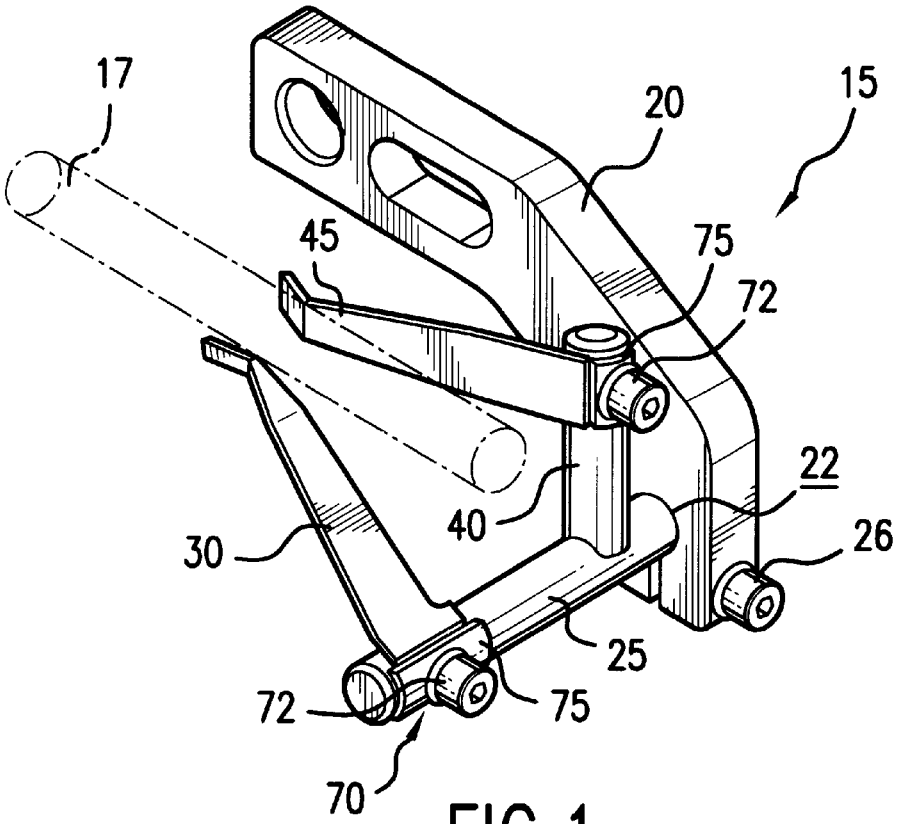
FIG. 1 is a perspective view of an arrow rest, according to one preferred embodiment of this invention.
Figure 2:
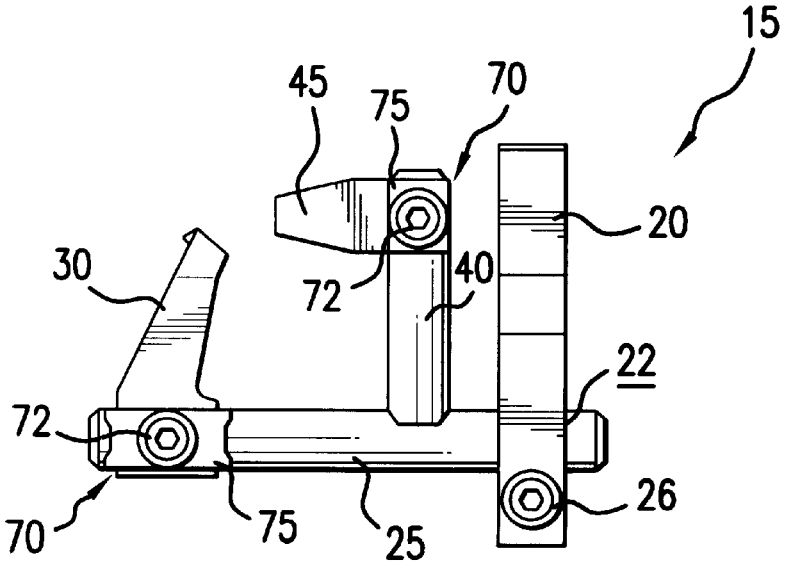
FIG. 2 is a front view of the arrow rest as shown in FIG. 1.
Figure 3:
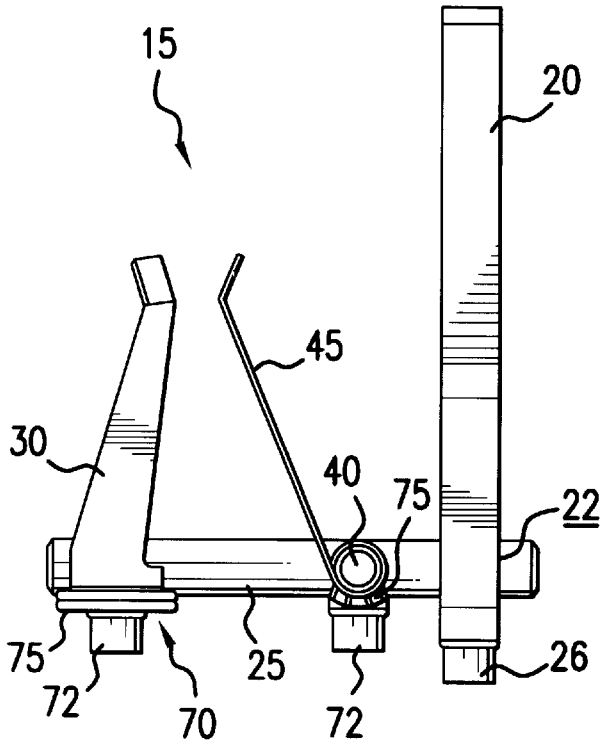
FIG. 3 is a top view of the arrow rest as shown in FIG. 1.
Figure 4:
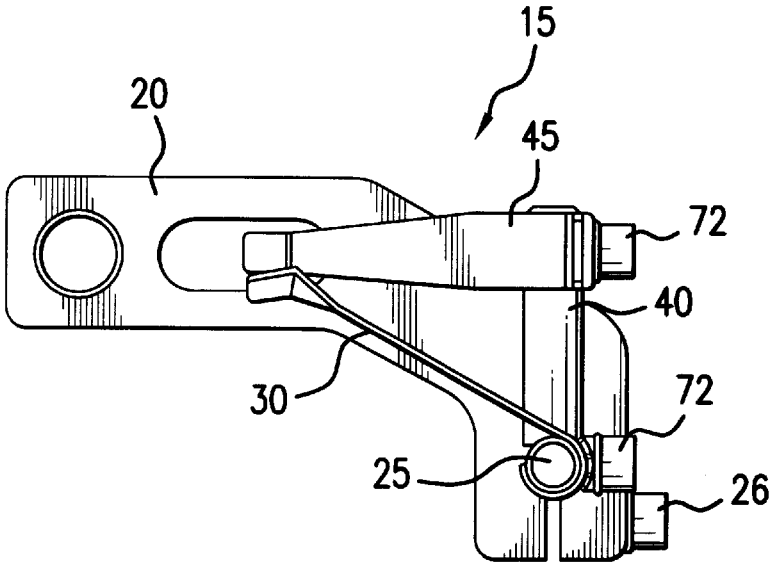
FIG. 4 is a side view of the arrow rest as shown in FIG. 1.

Referring to FIGS. 1–4, arrow rest 15 preferably includes bracket 20. Bracket 20 is preferably used to mount arrow rest 15 to an archery bow, specifically a bow riser. Bracket 20 is preferably configured to permit mounting to a variety of bow risers using a variety of methods and hardware.

According to one preferred embodiment of this invention, support shaft 25 extends from bracket 20. Preferably, support shaft 25 extends perpendicularly from bracket 20 thus resulting in a generally horizontal support shaft 25 with respect to bracket 20. Support shaft 25 is preferably an elongated shaft having a circular cross-section although support shaft 25 may alternatively comprise a rectangular, polygonal or any other suitable cross-section known to those having ordinary skill in the art.

As shown in FIGS. 1–4, support shaft 25 may extend from shaft aperture 22 positioned within bracket 20. According to one preferred embodiment of this invention, support shaft 25 is slideably connected with respect to bracket 20 through shaft aperture 22. As shown in FIGS. 1–4, shaft set screw 26 may be loosened to release engagement of bracket 20 from support shaft 25, thus permitting support shaft 25 to freely slide in a horizontal position relative to bracket 20. Upon reaching the desired position of support shaft 25, shaft set screw 26 may be tightened thus fixing support shaft 25 with respect to bracket 20.

As shown in FIGS. 1–4, first support arm 30 is connected with respect to support shaft 25. First support arm 30 is preferably constructed from spring steel or other inexpensive, resilient and durable material known to those having ordinary skill in the art. First support arm 30 preferably has memory so that incidental and/or intended forces do not permanently deform a physical shape or position of first support arm 30. Conversely, first support arm 30 should be permanently deformable when an appropriate force is exerted upon first support arm 30 to effect a desired adjustment to the physical shape or position of first support arm 30.

Figure 5:
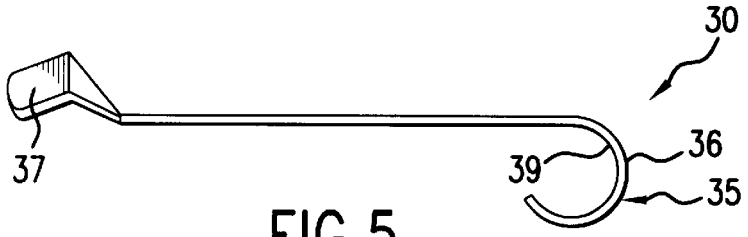
FIG. 5 is a side view of a first support arm, according to one preferred embodiment of this invention.
Figure 6:
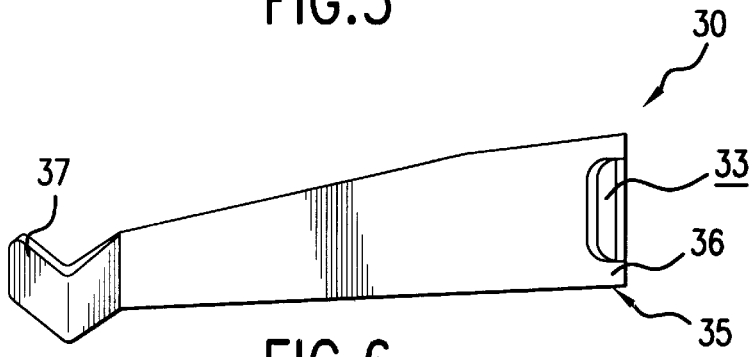
FIG. 6 is a top view of the first support arm as shown in FIG. 5.

First support arm 30, shown in detail in FIGS. 5 and 6, preferably has first arcuate end 35 and an opposite first support end 37. First arcuate end 35 is preferably connected with respect to support shaft 25 and first support end 37 preferably supports arrow shaft 17 in a vertical direction. In addition, first aperture 33 is preferably formed through a portion of first arcuate end 35. First aperture 33 may comprise a circular aperture, an oval-shaped aperture or any other appropriately shaped aperture.

According to one preferred embodiment of this invention, first arcuate end 35 is wrapped around support shaft 25. The term wrapped around refers to a mating engagement between two components such that an inner surface of a first component at least partially follows the contour of an outer surface of a second component, for example a contoured inner surface of an arcuate end positioned at least partially around a corresponding contour of an outer surface of a support shaft. For the purposes of this specification and the claims, wrapped around means an engagement of an interior surface with at least approximately 90° of a circumference of a circular surface or at least approximately one-quarter of a perimeter of a noncircular surface.

According to one preferred embodiment of this invention, first arcuate end 35 is wrapped at least 90° around support shaft 25. In the preferred embodiment of this invention shown in FIGS. 1–4, first inner surface 39 of first arcuate end 35 engages with an outer contour of support shaft 25 such that first arcuate end 35 wraps around support shaft 25 between approximately 180° and approximately 270°, although variations may also be used. When first arcuate end 35 is wrapped at least approximately 180°, first support arm is resists movement in a horizontal or lateral direction with respect to arrow rest 15 shown in FIGS. 1–4.

According to a preferred embodiment of this invention shown in FIGS. 1–4, arrow rest 15 further comprises post 40 extending at an angle from support shaft 25. As shown in the figures, post 40 preferably extends perpendicularly from support shaft 25, however, post 40 may extend at any other angle that may enhance the performance of arrow rest 15.

Figure 7:
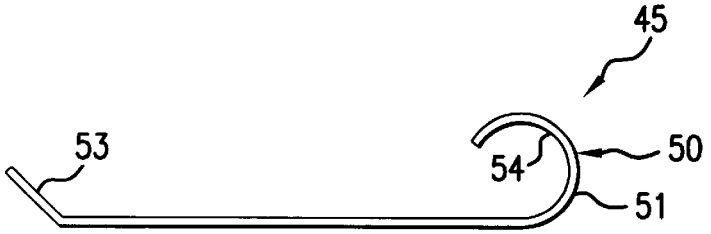
FIG. 7 is a side view of a second support arm, according to one preferred embodiment of this invention.
Figure 8:
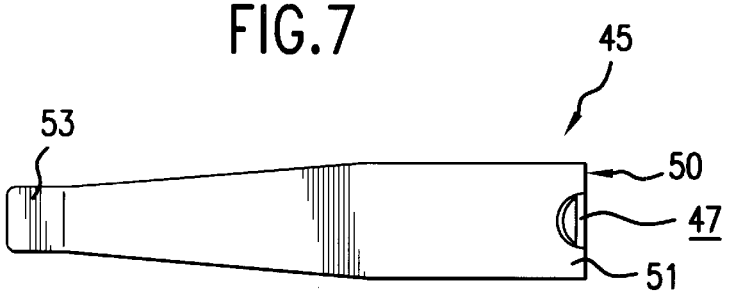
FIG. 8 is a top view of the second support arm as shown in FIG. 7.

Second support arm 45, shown in detail in FIGS. 7 and 8, preferably having second arcuate end 50 and second support end 53 is connected with respect to post 40. As discussed in the specification and the claims, second support arm 45 should exhibit most or all of the same physical qualities as first support arm 30, and other than physical shape and position, second support arm 45 and first support arm 30 should be interchangeable. As shown in FIG. 1, second support end 53 supports shaft 17 in a generally horizontal direction. Additionally, second arcuate end 50 is preferably wrapped around post 40.

In one preferred embodiment of this invention, first support arm 30 is connected to support shaft 25 and/or second support arm 45 is connected to post 40, using retention block 70. Retention block 70 preferably fixes first arcuate end 35 with respect to support shaft 25. Likewise, retention block 70 may be used to fix second arcuate end 50 with respect to post 40.

Figure 9:
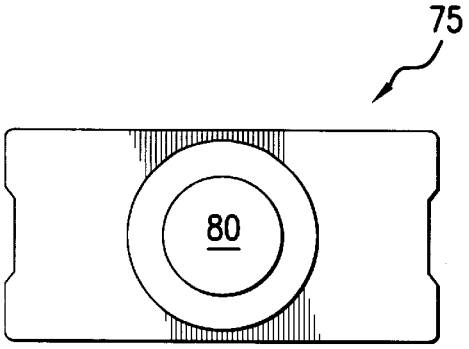
FIG. 9 is a top view of a washer, according to one preferred embodiment of this invention.
Figure 10:
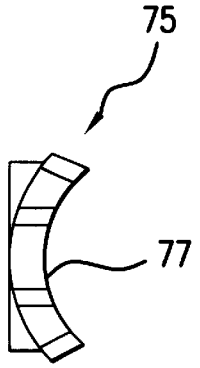
FIG. 10 is a side view of the washer as shown in FIG. 9.

Retention block 70 preferably comprises one or more components, including screw 72 and washer 75. Washer 75, shown in one preferred embodiment of this invention in FIGS. 9 and 10, includes inner surface 77 and washer aperture 80. Inner surface 77 preferably corresponds with first outer surface 36 of first arcuate end 35 and/or second outer surface 51 of second arcuate end 50.

According to one preferred embodiment of this invention, screw 72 connects first support arm 30 to support shaft 25 through washer aperture 80 and then through first aperture 33 in first arcuate end 35. Screw 72 is preferably retained in place through a threaded bore in support shaft 25 or alternatively by using a nut. When screw 72 is tightened, washer 75 abuts against first outer surface 36 of first arcuate end 35 thereby holding first support arm 30 in a firmly fixed position with respect to support shaft 25.

According to one preferred embodiment of this invention and in a similar manner as first support arm 30, screw 72 connects second support arm 45 to post 40 through washer aperture 80 and then through second aperture 47 in second arcuate end 50. Screw 72 is preferably retained in place through a threaded bore in post 40 or alternatively by using a nut. When screw 72 is tightened, washer 75 abuts against an outer surface of second arcuate end 50 thereby holding second support arm 45 in a firmly fixed position with respect to post 40.

When retention block 70 is loosened with respect to first support arm 30, first support arm 30 is, in one preferred embodiment of this invention, slideably attached with respect to support shaft 25. Depending upon the configuration of first aperture 33 in first arcuate end 35, first support arm 30 may be slideable along an axis of first aperture 33 or if first aperture 33 has a similar diameter as screw 72, first support arm 30 may be not slideable with respect to support shaft 25. Alternatively, support shaft 25 may be slotted along a longitudinal axis to permit sliding movement of first support arm 30 with respect to support shaft 25.

In one preferred embodiment of this invention, first arcuate end 35 may be rotatably attached with respect to support shaft 25 when retention block 70 is loosened. To permit limited rotation, first aperture 33 may be configured to permit rotation of first arcuate end 35 around support shaft 25. Alternatively, support shaft 25 may be slotted along a radial axis to permit rotational movement of first support arm 30 with respect to support shaft 25.

In a similar manner as first support arm 30 and support shaft 25, second support arm 45 may be slideably or rotatably connected with respect to post 40. Alternatively, second support arm 45 may be vertically adjusted by sliding post 40 with respect to support shaft 25. Post 40 may slide through a post aperture (not shown) in support shaft 25 or otherwise slide along an axis perpendicular to a centerline or longitudinal axis of support shaft 25.

Figure 11:
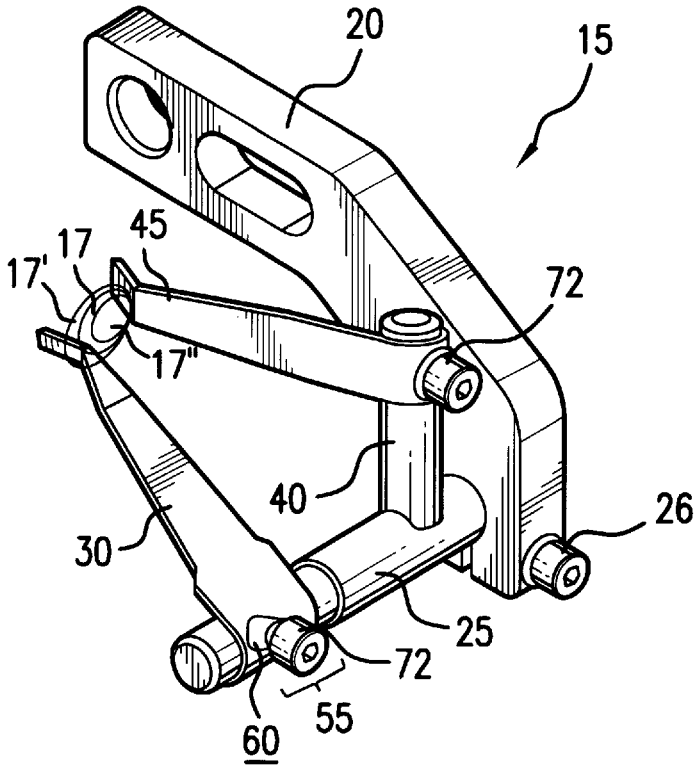
FIG. 11 is a perspective view of an arrow rest, according to one preferred embodiment of this invention.
Figure 12:
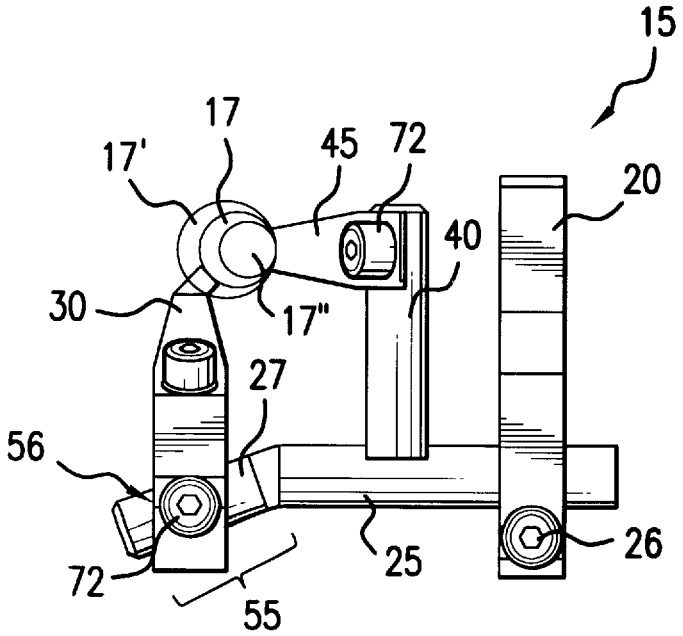
FIG. 12 is a front view of an arrow rest, according to one preferred embodiment of this invention.

In one preferred embodiment of this invention shown in FIGS. 11 and 12, arrow rest 15 further comprises means for positioning 55 first support arm 30 along an angular path with respect to bracket 15. As shown in FIG. 11, angled slot 60 positioned in first arcuate end 35 of first support arm 30 may be used to precisely adjust first support arm 30 at a predetermined angle to support a variety of diameters of shafts 17, 17', 17". According to a preferred embodiment of this invention shown in FIG. 12, adjustment mechanism 56 may be used for positioning first support arm 30 along an angular path with respect to bracket 15. Adjustment mechanism 56 comprises a retention block 70 that slides along an angled portion 27 of support shaft 25. As a result of adjustment mechanism 56, first support arm 30 may be adjusted along an angular path to accommodate a variety of diameters of shafts 17, 17', 17".

It is apparent that different elements can be exchanged between preferred embodiments discussed in this specification and shown in FIGS. 1–12. It is also apparent that arrow rest 15 and related components can be assembled in an inverted or mirror-image manner with respect to bracket 20 without departing from the basic principles of the invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described can be varied considerably without departing from the basic principles of the invention.

We claim:

1. An arrow rest comprising:

a bracket;

a support shaft extending from the bracket;

a first support arm having a first arcuate end wrapped around the support shaft; and a retention block fixing the first arcuate end with respect to the support shaft.

2. The arrow rest of claim 1 further comprising a post extending at an angle from the support shaft.

3. The arrow rest of claim 2 further comprising a second support arm having a second arcuate end wrapped around the post.

4. The arrow rest of claim 1 wherein the first support arm is slideably attached with respect to the support shaft.

5. The arrow rest of claim 1 wherein the first arcuate end is rotatably attached with respect to the support shaft.

6. The arrow rest of claim 1 wherein the retention block comprises a screw and a washer having an inner surface corresponding with an outer surface of the first arcuate end.

7. The arrow rest of claim 1 wherein the first arcuate end is wrapped at least 90° around the support shaft.

8. The arrow rest of claim 1 wherein the first arcuate end is wrapped at least 180° around the support shaft.

9. The arrow rest of claim 1 further comprising an adjustment mechanism for positioning the first support arm along an angular path with respect to the bracket.

10. The arrow rest of claim 1 wherein the support shaft is slideably attached with respect to the bracket.

11. An arrow rest for mounting to a bow with a bracket, the arrow rest comprising:

a support shaft extending generally perpendicular with respect to the bracket;

a first support arm having a first arcuate end wrapped around the support shaft wherein the first support arm is slideably connected with respect to the support shaft;

a post extending at an angle with respect to the post; and a second support arm having a second arcuate end wrapped around the post.

12. The arrow rest of claim 11 wherein the support shaft further comprises an angled portion.

13. The arrow rest of claim 11 wherein the support shaft is slideably connected with respect to the bracket.

14. The arrow rest of claim 11 wherein the post is slideably connected with respect to the support shaft.

15. An arrow rest for mounting to a bow with a bracket, the arrow rest comprising:

a support shaft extending generally perpendicular with respect to the bracket;

a first support arm having a first arcuate end wrapped around the support shaft;

a post extending at an angle with respect to the post; and a second support arm having a second arcuate end wrapped around the post wherein the second support arm is slideably connected with respect to the post.

16. The arrow rest of claim 15 wherein the first support arm is slideably connected with respect to the support shaft.

17. An arrow rest comprising:

a bracket;

a support shaft slideably mounted with respect to the bracket;

a first support arm having a first arcuate end wrapped around the support shaft; and a means for positioning the first support arm along an angular path with respect to the bracket.

18. The arrow rest of claim 17 further comprising a post extending from the support shaft, the post having a second support arm.

* * * * *